United States Patent [19]

Bell et al.

[11] 4,222,686

[45] Sep. 16, 1980

[54] MINE ROOF SUPPORT

[75] Inventors: Günter Bell, Horneburg; Willy Watermann, Dortmund-Lanstrop, both of Fed. Rep. of Germany

[73] Assignee: Kloeckner Werke, Duisburg, Fed. Rep. of Germany

[21] Appl. No.: 956,437

[22] Filed: Oct. 31, 1978

[30] Foreign Application Priority Data

Apr. 11, 1977 [DE] Fed. Rep. of Germany ..... 2749371

[51] Int. Cl.[2] ..... E21D 15/44

[52] U.S. Cl. ..... 405/295; 91/358 A; 405/291

[58] Field of Search ..... 405/291-302; 91/3, 358 A

[56] References Cited

U.S. PATENT DOCUMENTS

| | | | |
|---|---|---|---|
| 887,530 | 5/1908 | Scott et al. | 91/358 A X |
| 3,282,283 | 11/1966 | Takeda | 91/3 X |
| 3,420,393 | 1/1969 | Omon | 91/358 A X |
| 3,902,325 | 9/1975 | Sigott et al. | 405/296 |
| 4,077,223 | 3/1978 | Koppers et al. | 405/295 |

*Primary Examiner*—Dennis L. Taylor

*Attorney, Agent, or Firm*—Michael J. Striker

[57] ABSTRACT

In a mine roof support in which a roof shield, pressed by hydraulically operated, collapsable and extensible props, arranged between the roof shield and a sole plate, against the roof of a mine gallery, is connected at its rear end to a rear shield, which in turn is connected by links to the rear end of the sole plate and in which a hydraulically operated cylinder-and-piston unit is interconnected between the roof shield and the rear shield for controlling the included angle between these shields, an arrangement for stopping further feeding of pressure fluid into the props when the inclined angle between the shield reaches a predetermined minimum or maximum angle.

8 Claims, 6 Drawing Figures

22
27
22
27
32
29
33
35
47
49
34
48
40
37
23
23
56
55
50
51
58
P
R
59
60
58
61
38
39
52
57
54
53
a
b
c
a
b
c

MINE ROOF SUPPORT

BACKGROUND OF THE INVENTION

The present invention relates to a mine roof support in which a roof shield, pressed by hydraulically operated collapsable and extensible props arranged between the roof shield and a sole plate, against the roof of a mine gallery, is connected at its rear end to a rear shield, which in turn is connected by links to the rear end of the sole plate, and in which a hydraulically operated cylinder-and-piston unit is interconnected between the roof shield and the rear shield for controlling the included angle between the same.

Such mine roof supports are known in the art. In the end positions of the roof shield, that is in which the roof shield includes a maximum or a minimum angle with the rear shield, mechanical stops are provided in this known mine roof support for these end positions of the roof shield relative to the rear shield and such mechanical stops may be provided in the aforementioned cylinder-and-piston unit interconnected between the shields. In order to avoid in such a case damage of the mine roof support resulting from the tremendous forces transmitted from the props over the linkage onto the aforementioned stops, there have up to now been provided shear bolts as overload safety means, which in the event of an overload have been sheared off.

During operation of such mine roof supports in mine galleries of low height, the end stops will soon be engaged. If under such condition the shear bolt is sheared off, a new shear bolt has to be provided in its place to assure further safety against overload, which evidently reduces the efficiency of this known mine roof support.

SUMMARY OF THE INVENTION

It is an object of the present invention to provide a mine roof support of the above-mentioned kind which avoids the mentioned disadvantage of such known mine roof supports.

It is a further object of the present invention to provide a mine roof support of the above-mentioned kind in which the necessity of shear bolts is avoided and in which the operation safety and efficiency is considerably increased as compared with mine roof supports known in the art.

With these and other objects in view, which will become apparent as the description proceeds, the mine roof support according to the present invention mainly comprises a sole plate adapted to rest on the floor of a mine gallery and having a front end adapted to be directed to the face of the mine gallery and a rear end, a roof shield above the sole plate and having a front end extending beyond that of the sole plate, fluid operated extensible and collapsable prop means pivotably connected at opposite ends to the sole plate and the roof shield for pressing the latter against the roof of a mine gallery, a rear shield pivotably connected at one end to the rear end of the roof shield and including an angle with the latter, link means pivotably connecting the other end of the rear shield to the sole plate in the region of the rear end of the latter, means for feeding pressure fluid into the prop means, fluid operated means between the roof shield and the rear shield for changing the included angle between the shields and comprising a cylinder element and a piston element slidably guided in the cylinder element, and means cooperating with the aforementioned elements for stopping feeding of pressure fluid into the prop means upon reaching a maximum or a minimum included angle between the shields.

The piston element is movable between two end positions in the cylinder element and the aforementioned means for stopping feeding of pressure fluid into the prop means preferably comprise a pair of spaced stops connected to one of the elements for movement therewith and valve means connected to the other of the elements and arranged to stop further feeding of pressure fluid into the prop means when the piston element reaches either of its end positions and one of these stops engages the valve means.

The stops may be connected to the piston element, respectively to a piston rod fixed thereto and the valve means may be connected to the cylinder element, but, on the other hand, the stops may be connected to the cylinder element and the valve means to the piston element, respectively to the piston rod connected thereto.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
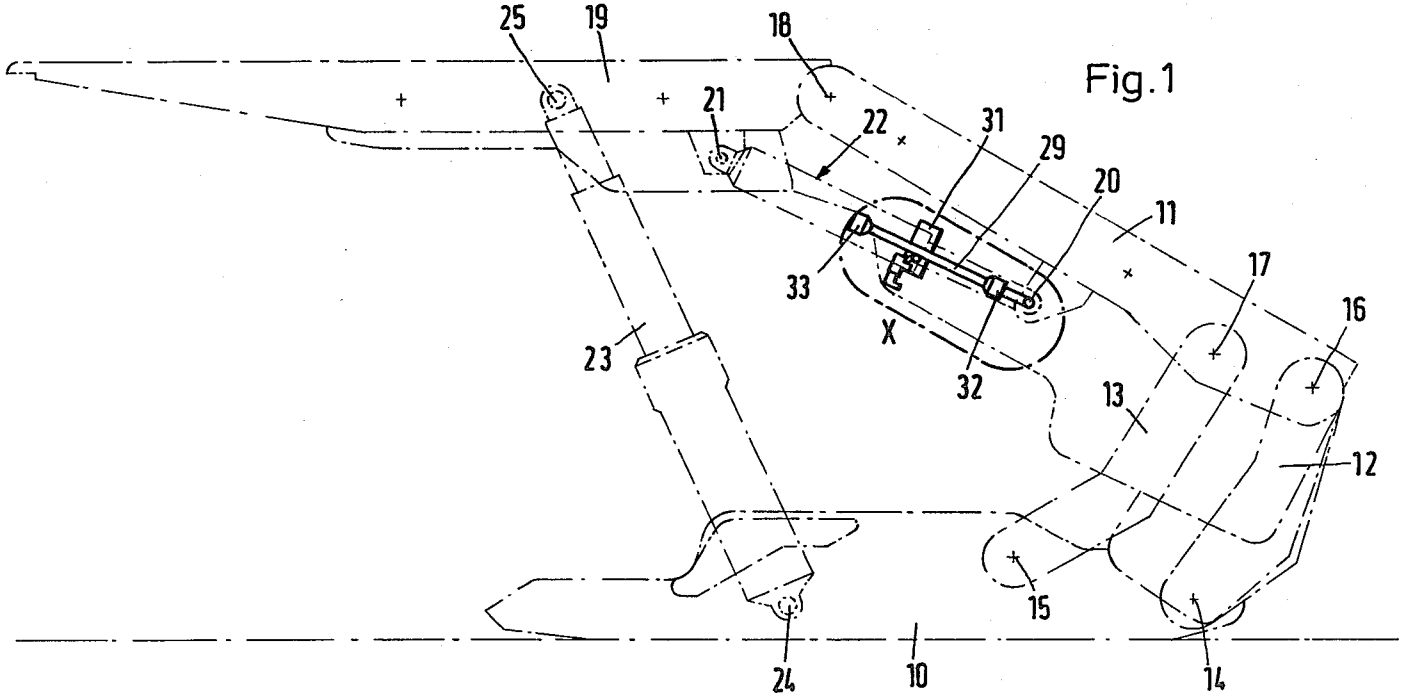
FIG. 1 is a side view of the mine roof support according to the present invention, in which the elements known in the art are shown in dash-dotted lines and the elements according to the present invention are shown in full lines.

As schematically illustrated in FIG. 1, the mine roof support according to the present invention comprises a sole plate 10 adapted to rest on the floor of a mine gallery, a roof shield 19 above the sole plate 10 and having a front end, shown in FIG. 1 at its left end, extending beyond the front end of the sole plate. Fluid-operated extensible and collapsable prop means 23 are pivotably connected at opposite ends to the sole plate 10 and the roof shield 19 for pressing the latter against the non-illustrated roof of a mine gallery. A rear shield 11 is pivotably connected at 18 to the rear end of the roof shield 19 and extends downwardly inclined with respect to the roof shield 19 toward the sole plate 10. The lower end of the rear shield 11 is pivotably connected at 16 and 17 to a pair of links 12 and 13, respectively, which in turn are pivotably connected at 14 and 15 to the region of the rear end of the sole plate 10. A fluid-operated cylinder-and-piston unit 22 is pivotably connected at opposite ends 20 and 21 to the rear shield 11 and the roof shield 19, respectively. While the schematic illustration in FIG. 1 shows only the front prop 23, the front links 12 and 13 and the front cylinder-and-piston unit 22 it is to be understood that two of each of these elements are provided arranged symmetrically with respect to a longitudinal plane of symmetry of the mine roof support.

Figure 2:
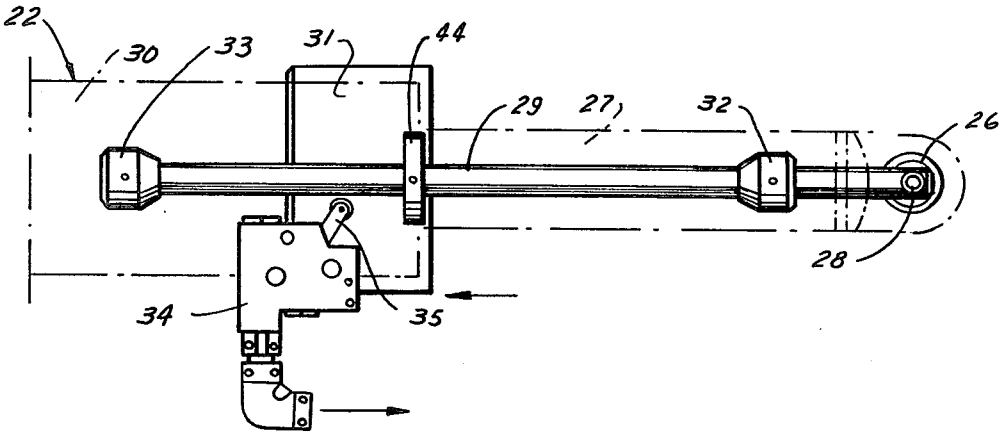
FIG. 2 is a side view of a portion of the mine roof support shown in FIG. 1 encompassed by the dash-dotted line X.
Figure 3:
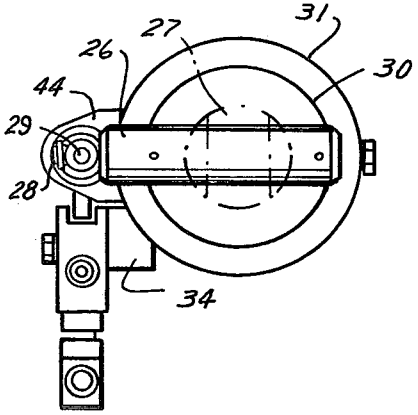
FIG. 3 is an end view of the arrangement shown in FIG. 2, as viewed from the right side of FIG. 2.

As especially clearly shown in the enlarged view of FIGS. 2 and 3, the connecting bolt 26 which connects the aforementioned cylinder-and-piston unit 22 to the bearing 20 on the rear shield 11, is provided with an axial extension 28 which connects a control rod 29 to the end of the piston rod 27 projecting beyond the cylinder 30 of the cylinder-and-piston unit 22. The adjacent end of the cylinder 30 is provided with a guide bushing 31 and the guide bushing 31 carries a guide member 44 guiding the control rod 29 for axial movement together with the piston rod 27. The control rod 29 carries axially spaced from each other a pair of stops 32 and 33 fixedly connected thereto. Valve means 34 with an operating member 35 are connected in the embodiment shown in FIGS. 2 and 3 to the cylinder 30 of the cylinder-and-piston unit 22.

The piston rod 27 and therewith the control rod 29 are illustrated in FIG. 2 in the middle position corresponding to the position of the roof shield 19 and the rear shield 11 as shown in FIG. 1. If the piston rod 27 and therewith the control rod 29 are moved further out, that is towards the right, as viewed in FIG. 2, the stop 33 will engage the actuating member 35 of the valve means 34 to move the actuating member 35 from the position illustrated in FIG. 2 to thereby stop, in a manner as will be explained later on, further feeding of pressure fluid to the prop means 23. The same occurs when the piston rod 27 and the control rod 29 move from the position as shown in FIG. 2 toward the left, as viewed in FIG. 2, so that the stop 32 will engage the operating member 35 to thereby also interrupt further feeding of pressure fluid to the prop means 23.

Figure 4:
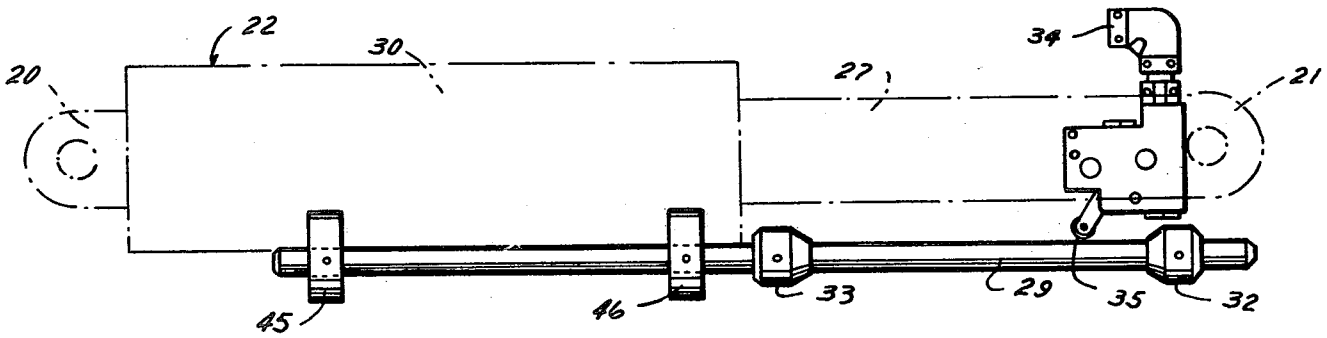
FIG. 4 is a side view similar to FIG. 2 and showing a modification of the arrangement shown in FIG. 2.
Figure 5:
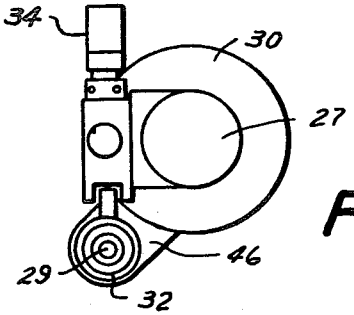
FIG. 5 is an end view of the arrangement shown in FIG. 4, as viewed from the right side of the latter.

FIGS. 4 and 5 illustrate a slight modification of the above-described arrangement in which the aforementioned valve means 34 with the operating member 35 are connected to the piston rod 27 adjacent the free end of the latter, whereas the control rod 29 is connected by the members 45 and 46 to the cylinder 30 of the cylinder-and-piston unit 22 to project with a portion thereof beyond the cylinder 30 in the direction of the piston rod 27 and the projecting portion of the control rod 29 again carries axially spaced from each other the two stops 32 and 33. In both arrangements the control rod 29 extends parallel to the piston rod 27 and it is to be understood that the stops 32 and 33 are arranged on the control rod 29 so as to engage and displace the operating member 35 when the piston of the unit 22 reaches either of its end positions in the cylinder 30.

Figure 6:
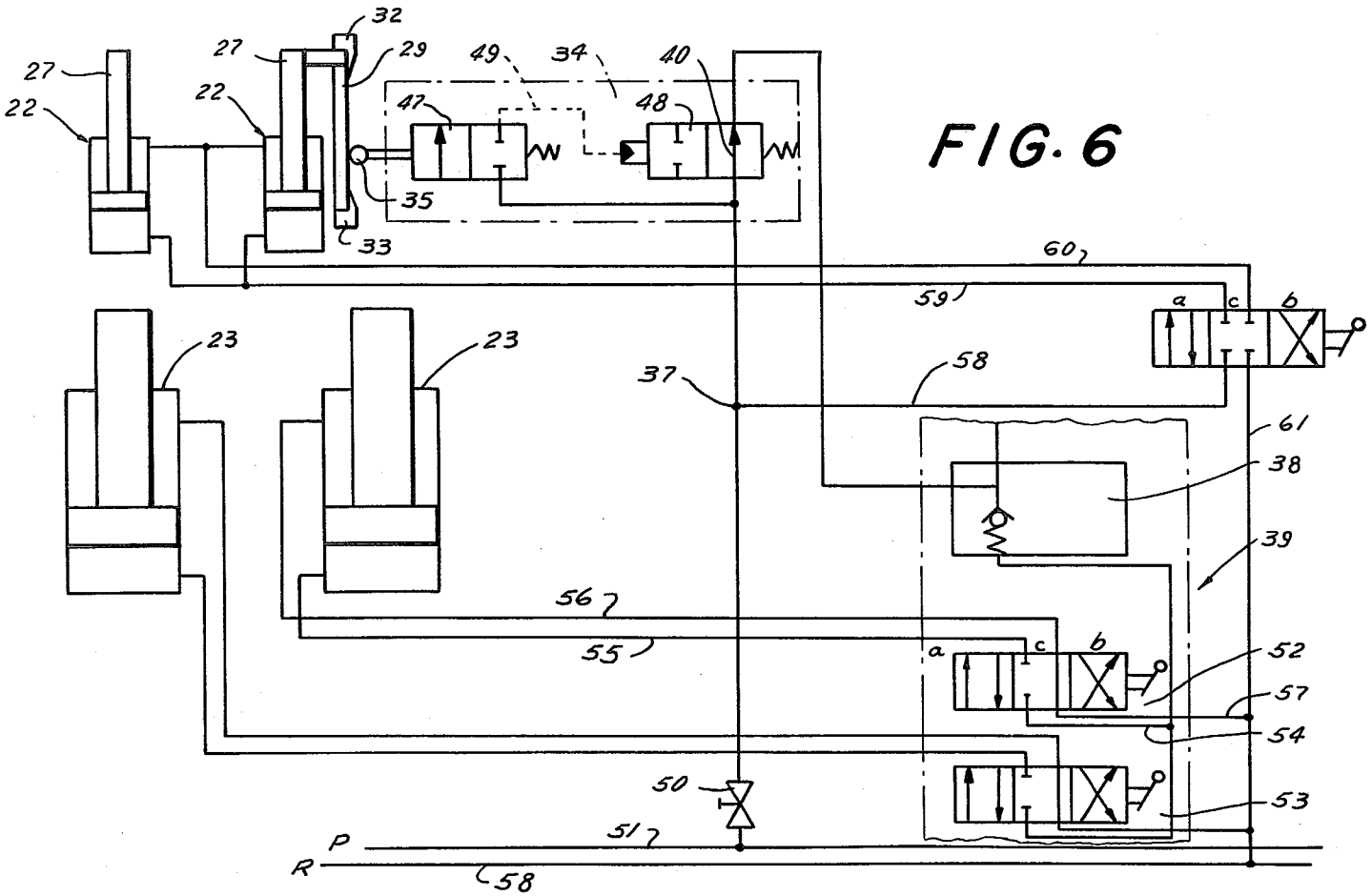
FIG. 6 illustrates the hydraulic circuit arrangement according to the present invention.

FIG. 6 illustrates the hydraulic circuit arrangement according to the present invention. As shown in FIG. 6, this circuit arrangement comprises two conduits 51 and 58 and the letters P and R at the ends of these conduits indicate that the conduit 51 is a pressure conduit connected to a non-illustrated source of fluid pressure and that the conduit 58 is a return conduit connected to a non-illustrated tank. A conduit 37 is connected over a normally open valve 50 to the pressure conduit 51 and leads to the valve 48 of the valve means 34 to be described in further detail later on and from there over a valve arrangement 39 cooperating with the props 23. A conduit 58 branching off from the conduit 37 leads to a control valve 43 which in turn is connected by conduits 59 and 60 to opposite ends of the cylinders of the cylinder-and-piston units 22. The valve arrangement 39 comprises a main valve 38, here shown as a non-return or one-way valve, and two four port-three position valves 52 and 53 of identical constructions.

The valve means 34 comprises two two port-two position valves 47 and 48 of which the valve 47 is provided with the control member 35.

In the positions of the valves shown in FIG. 6, no pressure fluid will be fed in any of the cylinders shown. If the control valve 43 and the valves 52 and 53 are moved from the position c shown in FIG. 6, for instance to the working position a, pressure fluid will flow from the pressure conduit 51 over the conduit 37, the closed valve 48, the one-way valve 38, the valves 52 and 53 and over the conduits 55 into the spaces below the pistons of the props 23 to raise the latter, while at the same time pressure fluid will also flow over the branch conduit 58, the valve 43, the conduit 59 to the spaces below the pistons of the cylinder-and-piston units 22 so as to move the piston rods 27 out of the cylinders of these units. During outward movement of the piston rods 27 the control rod 29 connected to one of the piston rods is moved correspondingly so that the stop 33 will engage the control member 35 to move the valve 47 toward the right, as viewed in FIG. 6, so that pressure fluid from the conduit 37 will pass into the control conduit 49, thereby imparting an impulse to the valve 48 and moving the same from the position shown in FIG. 6 toward the right, so that further flow of pressure fluid to the valve arrangement 39 is interrupted and no further pressure fluid is fed to the props 23.

During movement of the props 23 to the extended position as well as during movement of the piston rods 27 out of the cylinders of the cylinder-and-piston units 22, the pressure fluid above the pistons of the props 23 will be discharged through the conduits 56 and the valves 52 and 53 and the branch conduits 57, respectively connected to the conduit 61, which in turn is connected to the return conduit 58, whereas pressure fluid from the cylinders of the cylinder-and-piston units 22 will be discharged through the conduit 60, likewise connected to the conduit 61 in the position a of the control valve 43.

It will also be evident from FIG. 6 that interruption of feeding of pressure fluid to the props 23 will occur when the valves 43, 52 and 53 are moved to the other working position b in which the props 23 are gradually collapsed and the piston rod 27 is drawn inwardly, when the stop 32 on the control rod 29 engages the control member 35 to displace the latter.

It will be understood that each of the elements described above, or two or more together, may also find a useful application in other types of mine roof supports differing from the types described above.

While the invention has been illustrated and described as embodied in a mine roof support provided with an arrangement for stopping feeding of pressure fluid into the props pressing the roof shield against a mine roof when this roof shield includes a predetermined angle with the rear shield of the mine roof support, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A mine roof support comprising a sole plate adapted to rest on the floor of a mine gallery and having a front end adapted to be directed to the face of the mine gallery and a rear end; a roof shield above said sole plate and having a front end extending beyond that of said sole plate and a rear end; fluid-operated extensible and collapsible prop means pivotably connected at opposite ends to said sole plate and said roof shield for pressing the latter against the roof of the mine gallery; a rear shield pivotably connected at one end to said rear end of said roof shield and including an angle with the latter; link means pivotably connecting the other end of said rear shield to said sole plate in the region of the rear end of the latter; means for feeding pressure fluid into said prop means; fluid-operated means between said roof shield and said rear shield for changing the included angle between said shields and comprising a cylinder element and a piston element slidably guided in said cylinder element; and means cooperating with said elements for stopping feeding of pressure fluid into said prop means upon reaching of a maximum as well as upon reaching of a minimum included angle between said shields.

2. A mine roof support as defined in claim 1, wherein said piston element is movable between two end positions in said cylinder element, and wherein said means for stopping feeding of pressure fluid into said prop means comprises a pair of spaced stops connected to one of said elements and valve means connected to the other of said elements and arranged to stop further feeding of pressure fluid into said prop means when said piston element reaches either of its end positions and one of said stops engages said valve means.

3. A mine roof support as defined in claim 2, wherein said stop means are connected to said piston element and said valve means are connected to said cylinder element for movement therewith.

4. A mine roof support as defined in claim 2, wherein said stops are connected to said cylinder element and said valve means to said piston element for movement therewith.

5. A mine roof support as defined in claim 3, and including a piston rod fixed at one end to said piston element for movement therewith, and a control rod connected to said piston rod, said stops being mounted spaced from each other on said control rod.

6. A mine roof support as defined in claim 5, and including a bolt pivotably connecting the other end of said piston rod to one of said shields, said control rod being connected at one end to said bolt, and guide means on said cylinder element for guiding said control rod.

7. A mine roof support as defined in claim 5, wherein said control rod extends substantially parallel to said piston rod.

8. A mine roof support as defined in claim 1, wherein said prop means is pivotally connected at one end to said roof shield intermediate the ends of the latter.

* * * * *